US006049961A

United States Patent [19]

Wieres

[11] Patent Number: 6,049,961

[45] Date of Patent: Apr. 18, 2000

[54] PROCESS FOR PRODUCING A HONEYCOMB BODY, ESPECIALLY A CATALYST CARRIER BODY

[75] Inventor: Ludwig Wieres, Overath, Germany

[73] Assignee: Emitec Gesellschaft fuer Emissionstechnologie mbH, Lohmar, Germany

[21] Appl. No.: 08/990,352

[22] Filed: Dec. 15, 1997

Related U.S. Application Data

[63] Continuation of application No. PCT/EP96/02094, May 15, 1996.

[30] Foreign Application Priority Data

Jun. 14, 1995 [DE] Germany ..... 195 21 685.7

[51] Int. Cl.[7] ..... B21D 39/00

[52] U.S. Cl. ..... 29/505; 29/515; 29/890; 29/890.08; 422/180; 72/148

[58] Field of Search ..... 29/890, 890.08, 29/505, 515; 242/530.2, 535.1; 422/180; 502/439; 72/146, 148

[56] References Cited

U.S. PATENT DOCUMENTS 4,163,042 7/1979 Lynch .
4,413,400 11/1983 Fischell .
4,964,587 10/1990 Oki et al. .
5,105,539 4/1992 Maus et al. .
5,135,794 8/1992 Maus et al. .
5,139,844 8/1992 Maus et al. .
5,608,968 3/1997 Maus et al. .
5,791,044 8/1998 Whittenberger et al. .
5,820,835 10/1998 Sheller et al. .
5,852,274 12/1998 Watanabe et al. .

*Primary Examiner*—David P. Bryant
*Attorney, Agent, or Firm*—Herbert L. Lerner; Laurence A. Greenberg; Werner H. Stemer

[57] ABSTRACT

An apparatus and a process produce a honeycomb body from at least one stack having a multiplicity of at least partially structured sheets which form a multiplicity of passages through which a fluid can flow. The apparatus includes a fork-shaped winding device which is rotatable about an axis and which engages each stack, as well as former segments which close to constitute a former. The former is formed from at least two former segments. Each former segment is pivotable in opposite relationship to the direction of rotation of the winding device about a respective pivot axis which respectively extends parallel to the axis of the winding device.

4 Claims, 6 Drawing Sheets

PROCESS FOR PRODUCING A HONEYCOMB BODY, ESPECIALLY A CATALYST CARRIER BODY

CROSS-REFERENCE TO RELATED APPLICATION

This application is a continuation of International Application Ser. No. PCT/EP96/02094, filed May 15, 1996, which designated the United States.

BACKGROUND OF THE INVENTION

Field of the Invention

The present invention relates to an apparatus and a process for producing a honeycomb body having a multiplicity of passages which are permeable to a fluid, in particular a catalyst carrier body.

Catalyst carrier bodies are used to eliminate pollutants, in particular in motor vehicle exhaust gases. Such catalyst carrier bodies may involve metallic honeycomb bodies. The honeycomb body includes a stack having a multiplicity of at least partially structured sheet metal layers. The stack is twisted in opposite directions about itself and about a central region. Such a structural configuration for a honeycomb body is known, for example, from U.S. Pat. No. 4,923,109.

International Patent Publication WO 90/03220, corresponding to U.S. Pat. Nos. 5,139,844; 5,105,539 and 5,135,794, discloses a metallic catalyst carrier body for motor vehicles, which is composed of at least partially structured sheet metal layers. That catalyst carrier body includes at least three stacks of sheet metal layers, wherein at least three of the stacks are each folded about a respectively associated bend line in the central region of the honeycomb body and in the folded condition are twisted in the same direction about each other and about the central region with the bend lines.

Known apparatuses for producing such catalyst carrier bodies include a fork-shaped wrapping or winding device which is rotatable about an axis and which engages each stack, as well as former segments which close to constitute a former. The inside contour of the closed former corresponds to the outside contour of the honeycomb body in the wrapped or wound condition. The most frequent shape in which the honeycomb body is produced is cylindrical. In order to ensure that the stacks are wound around themselves and around a central region, the former segments are moved towards the stack in such a way that, during the rotary movement of the forked twisting device, the stack or stacks bear against the edge of the former segments and that edge forms a support device. Towards the end of the production procedure the former is completely closed and thus imparts the definitive form to the honeycomb body.

The known apparatuses have two former segments which are movable towards each other and away from each other in a straight line. During the closing operation there is a danger of at least one of the former segments moving in the opposite direction to the direction of movement of a portion of a stack which is still to be twisted. If the former segment encounters the portion of the stack, that can give rise to undesired deformation of the stack or stacks. That deformation has the result of causing individual sheet metal layers to be partially buckled. As a result the structure of the finished honeycomb body is adversely affected. On one hand the strength of the honeycomb body suffers as a result and on the other hand there is a local variation in the passage cross-sections.

SUMMARY OF THE INVENTION

It is accordingly an object of the invention to provide an apparatus and a method for producing a honeycomb body, especially a catalyst carrier body, which overcome the hereinafore-mentioned disadvantages of the heretofore-known devices and processes of this general type and in which a risk of deformation of individual stacks or individual sheet metal layers does not arise during the production procedure.

With the foregoing and other objects in view there is provided, in accordance with the invention, an apparatus for producing a honeycomb body, in particular a catalyst carrier body, comprising a fork-like winding device for engaging a stack of a multiplicity of at least partially structured sheet metal layers forming a multiplicity of fluid-permeable passages, and for rotating about a central axis in a given direction of rotation; and a former having at least two former segments each pivotable about a respective pivot axis parallel to the central axis in a direction opposite to the given direction, for closing to correspond to an outside shape of a honeycomb body to be produced.

The pivotal movement of each former segment in opposite relationship to the direction of rotation of the winding device ensures that one or more sheet metal stacks is or are not upset upon closure of the former.

In accordance with another feature of the invention, the axis of each former segment is disposed in the vicinity of an outer boundary line of the honeycomb body to be produced.

In accordance with a further feature of the invention, when dealing with more than two stacks, the apparatus has a number of former segments which corresponds to the number of stacks, and the former segments are pivotable in opposite relationship to the direction of rotation of the winding device.

In accordance with an added feature of the invention, the pivot axes of the former segments are disposed equidistantly relative to each other on an envelope around the finished honeycomb body.

The sheet metal layers of the stack of a honeycomb body are subjected to a heavy loading by virtue of the structure of the known apparatus for producing a honeycomb body. The loading on the sheet metal layers is due inter alia to the fact that a support device is disposed at a spacing relative to the center of application of the forces. The system formed of the support device, the sheet metal stacks and the center of application of forces is comparable to a laminated leaf spring which is clamped at one end. Friction occurs between the individual layers of a stack as is also found in the case of a laminated leaf spring of that kind. Those frictional effects involve an increased application of energy in the winding operation. Furthermore, the portion of each stack which has not yet been wound around is buckled, so that the stack has to be subjected to a squeezing or pressing operation.

In accordance with an additional feature of the invention, the former segments each have an end forming a support device movable toward and away from the central axis, and each pivot axis is disposed at a respective one of the ends.

The apparatuses and advantageous developments of the methods involve the basic concept that the possibility of producing a honeycomb body having a plurality of passages which are permeable for a fluid, in particular a catalyst carrier body, is more desirable if the support device bears directly against the wrapped stack or stacks. The portion of each stack which has not yet been wrapped around is free.

Therefore, there are no loadings on the portion of the stack which has not yet been wrapped around, as is the case in the state of the art. There is therefore no bending loading on the portion of the stack which has not yet been wrapped around.

This basic concept is realized in an apparatus for producing a honeycomb body having a plurality of passages through which a fluid can flow, in particular for a catalytic converter, including a stack of a multiplicity of at least partially structured sheet metal layers, a fork-shaped winding device rotatable about an axis and engaging the stack, former segments closing to form a former, and a pivot axis disposed at a respective end of each former segment forming a support device each being displaceable towards and away from the axis. In that apparatus the support device always bears against the stack during the winding operation. The radial extent of the stack which has already been wound around increases during the winding procedure. In order to take that procedure into account, the support device is displaceable towards and away from the axis of the winding device. The support device can bear against the stack with a definite pressure force.

If the honeycomb body is formed from at least three stacks having a plurality of at least partially structured sheet metal layers and the stacks are simultaneously twisted around each other, the number of former segments of the former corresponds to the number of stacks. Each former segment is pivotable about a pivot axis which extends parallel to the axis, and is disposed at an end forming a respective support device. The former segments are pivotable in opposite relationship to the direction of rotation of the winding device. Each support device is displaceable towards and away from the axis of the winding device. A honeycomb body as is described in International Patent Publication WO 90/03220, corresponding to U.S. Pat. Nos. 5,139,844; 5,105,539 and 5,135,794, can be produced through the use of such an apparatus.

In accordance with yet another feature of the invention, there is provided a base plate with guide grooves extending radially with respect to the center. A pin forming a pivot axis is slidably guided in each guide groove. Each guide groove has a polygonal cross-section. A preferred configuration of the guide groove has a T-shaped or detail-shaped cross-section. The pin has a corresponding head which engages into the guide groove. It is not necessary for the guide grooves to be provided in an integral base plate. The guide grooves can also be assembled from a plurality of plates of appropriate configuration.

In accordance with yet a further feature of the invention, the movement of the support device towards and away from the axis is effected by an electric motor. A suitable motor to be used for that purpose is in particular a stepping motor since it provides for precise adjustability of the displacement of the support device of the stack which has already been wound. A suitable transmission may also be provided between the electric-motor drive and the support device. It is also possible to envisage other possibilities. Thus, for example, a toothed rack which is connected at one end to the support device and which can be brought into engagement with a corresponding gear of an electric-motor drive can be used.

In accordance with yet an added feature of the invention, each support device is connected to a piston-cylinder unit. The piston-cylinder unit can be operated hydraulically or pneumatically. In that respect it is possible to use known standardized piston-cylinder units.

In accordance with yet an additional feature of the invention, the pivot axes are displaced away from the central axis against a spring force. Such a spring force can be produced through the use of a tension spring or a compression spring or pairings of such springs. Preferably, the spring force with which the support device bears against the twisted stack is adjustable. That can provide for an adaptation of the apparatus to the shape and the starting materials of the honeycomb body. Preferably, the spring force has a degressive characteristic. That is based on the consideration that the force with which the support device bears against the stack can be less than in the core of the bent stack, by virtue of the greater bending radius. The use of springs is also advantageous since they involve standardized components which operate securely and reliably.

In accordance with again another feature of the invention, in order to close the former, each former segment is connected to a drive unit which pivots a corresponding former segment about the respective pivot axis. That drive unit may be a hydraulically or pneumatically operated piston-cylinder unit.

With the objects of the invention in view there is also provided a process for producing a honeycomb body with a multiplicity of fluid-permeable passages from a multiplicity of at least partially structured sheet metal layers, which comprises layering a stack from a plurality of at least partially structured sheet metal layers; introducing the stack into an open former having former segments corresponding to an outside shape of a honeycomb body to be produced; holding the stack in the former in a central region with a winding device; winding the stack around in a given direction of rotation; and closing the former by pivotal movement of the former segments in a direction opposite to the given direction when a predetermined degree of winding is reached. The winding device can be of a forked configuration.

The former can be closed when a predetermined degree of winding is achieved. It is not essential for the stack to be completely wound around itself. The operation of closing the former can already be initiated when the extent of the portion of the stack which has not yet been wound around is less than or equal to the length in the peripheral direction of the former segment. If the closing operation is already initiated then, each segment assists with the winding operation since the segments urge the portions which have not yet been wound around, towards the axis as they close. That process produces a honeycomb body which is known from Published European Patent Application 0 245 737 A1. Such a honeycomb body is familiar to one skilled in the art under the name S-Cat.

With the objects of the invention in view there is additionally provided a process for producing a honeycomb body having a multiplicity of fluid-permeable passages from a multiplicity of at least partially structured sheet metal layers, which comprises layering a plurality of stacks from a plurality of at least partially structured sheet metal layers; folding each stack about a respective bend line; introducing the stacks into an open former having former segments corresponding to an outside shape of a honeycomb body to be produced; holding the stacks in the former in a central region with a winding device; winding the stacks around each other in a given direction of rotation; and closing the former by pivotal movement of the former segments in a direction opposite to the given direction when a predetermined degree of winding is reached.

This produces a honeycomb body which has a plurality of passages that are permeable to a fluid, from a plurality of at least partially structured sheet metal layers, as is described, for example, in International Patent Publication WO 89/03220.

In accordance with a concomitant mode of the invention, after the winding device has engaged the stack, a respective support device is disposed on each side of the stack in the central region, the support device being positioned in opposite relationship, and brought to bear against the stack. The stack is then wound around itself in opposite directions. During the winding operation each support device moves radially out of the central region, with the support device always bearing against the stack. When the winding operation is concluded the former segments are pivoted about their respective pivot axis whereby the former is closed.

Other features which are considered as characteristic for the invention are set forth in the appended claims.

Although the invention is illustrated and described herein as embodied in an apparatus and a method for producing a honeycomb body, especially a catalyst carrier body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
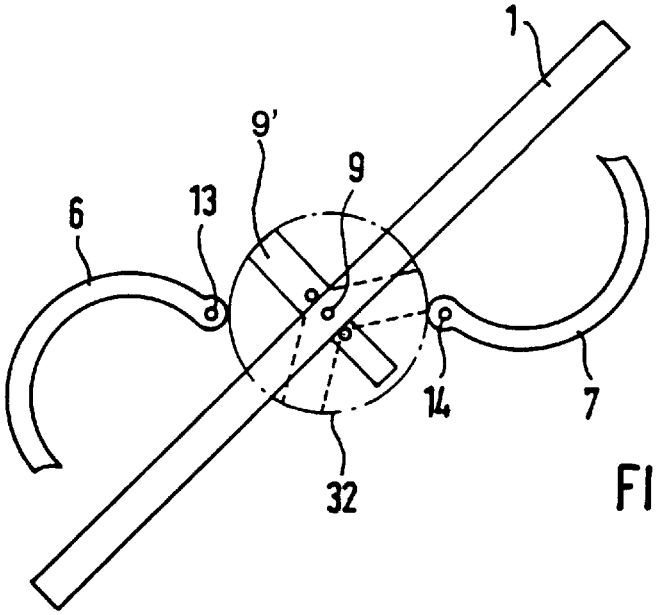
FIG. 1 is a diagrammatic, plan view of a first embodiment of an apparatus with a stack.
Figure 2:
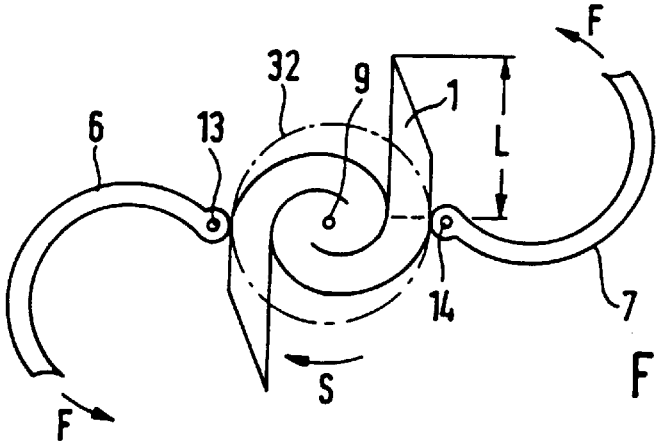
FIG. 2 is a diagrammatic, plan view of the apparatus shown in FIG. 1 with a partially wound stack.
Figure 3:
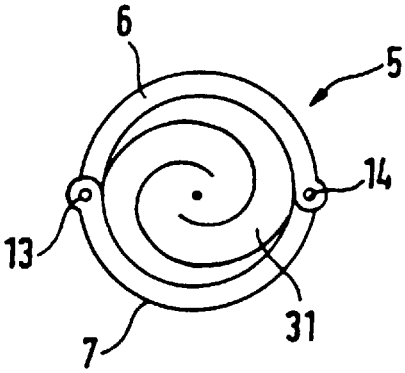
FIG. 3 is a diagrammatic, plan view of the apparatus of FIG. 1 with a closed former.

Referring now to the figures of the drawings in detail and first, particularly, to FIGS. 1–3 thereof, there is seen a first embodiment of an apparatus for producing a honeycomb body from a stack 1. The stack 1 includes a plurality of at least partially structured sheet metal layers which are not shown in FIGS. 1 to 3. In a finished honeycomb body the at least partially structured sheet metal layers form a plurality of passages which are permeable to a fluid. The apparatus includes a former 5 which has two former segments 6 and 7. Each former segment 6 and 7 is pivotable about a respective pivot axis 13, 14. The ends of each former segment 6, 7 are configured in such a way that the closed former forms an almost continuous line. In the illustrated embodiment, a honeycomb body 31 has a circular cross-section. The two former segments 6, 7 are formed diametrically on an envelope 32 at an outer boundary line of a honeycomb body to be produced.

The stack 1 is introduced into the open former 5 and retained there by a winding device 9'. The winding device is of a forked configuration and is rotatable about an axis 9 which is perpendicular to the plane of the drawing. The direction of rotation of the winding device 9' about the axis 9 is indicated by reference symbol S. It will be seen from FIG. 2 that the stack has been partially twisted. A part of the stack 1 which has not yet been wound around has a length L which corresponds to half the periphery of the envelope 32. In this stage of the process the former segments 6, 7 can be pivoted in the directions indicated by an arrow F about the respective pivot axes 13, 14 in order to thereby close the former 5. When that happens, the former segments 6, 7 press the portion of the stack 1, which has not yet been wound around, against a core of the stack.

Figure 4:
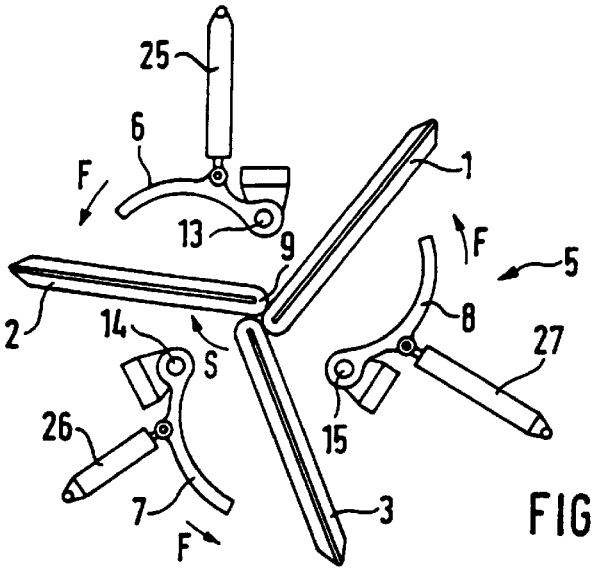
FIG. 4 is a diagrammatic, plan view of a second embodiment of an apparatus with three stacks.
Figure 5:
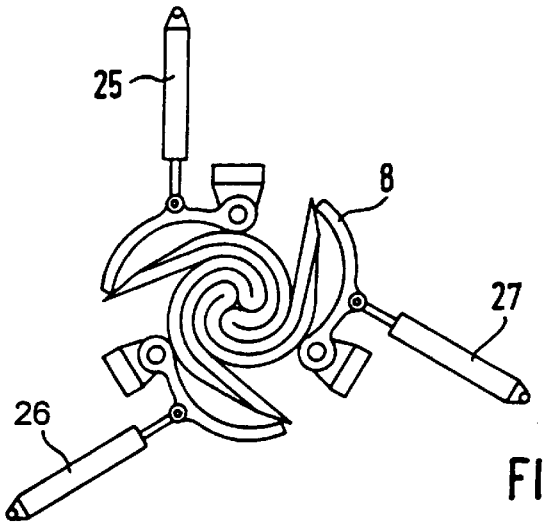
FIG. 5 is a diagrammatic, plan view of the apparatus of FIG. 4 with stacks which are partially wound one around the other.
Figure 6:
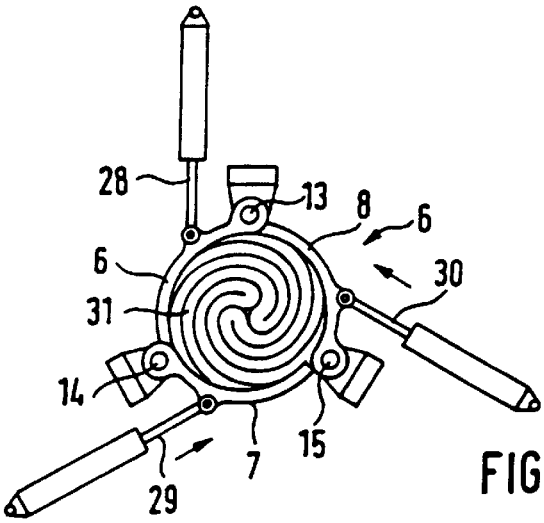
FIG. 6 is a diagrammatic, plan view of the apparatus of FIG. 4 with the former closed.

FIGS. 4 to 6 show a second embodiment of an apparatus for producing a honeycomb body having three stacks 1, 2 and 3. The stacks 1, 2 and 3 are disposed symmetrically about the axis 9. A winding device which retains each stack 1, 2 and 3 and rotates it in the direction of rotation S is not shown for the sake of improved clarity of the drawing. As was already stated, the winding device may involve a forked device. The former 5 includes three former segments 6, 7 and 8. Each former segment 6, 7 and 8 is in the form of a sector of a circle. Each former segment 6, 7 and 8 is pivotable about a respective axis 13, 14 and 15 in a direction F which is in opposite relationship to the direction of rotation S of the winding device. A respective drive unit 25, 26, 27 is provided to produce the pivotal movement of each former segment 6, 7 and 8. The drive units 25, 26 and 27 each involve a hydraulically or pneumatically operated piston-cylinder unit. Piston rods 28, 29, 30 are respectively connected to the former segments 6, 7 and 8. The connection is a pivotable one. Each drive unit 25, 26, 27 is disposed stationarily.

The respective piston rods 28, 29 and 30 are extended by suitably building up pressure within the respective piston-cylinder units 25, 26 and 28, whereby each segment 6, 7 and 8 is pivoted about the respective pivot axis 13, 14 and 15 and the former is closed. The closed condition of the former is shown in FIG. 6.

Figure 9:
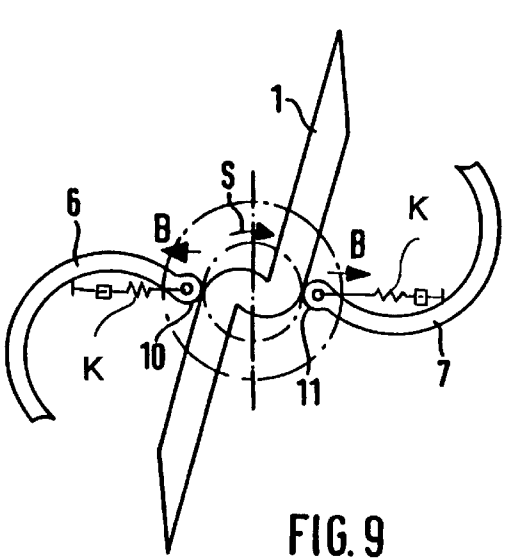
FIGS. 7 to 12 are diagrammatic, plan views of a third embodiment of an apparatus in different operating stages.
Figure 8:
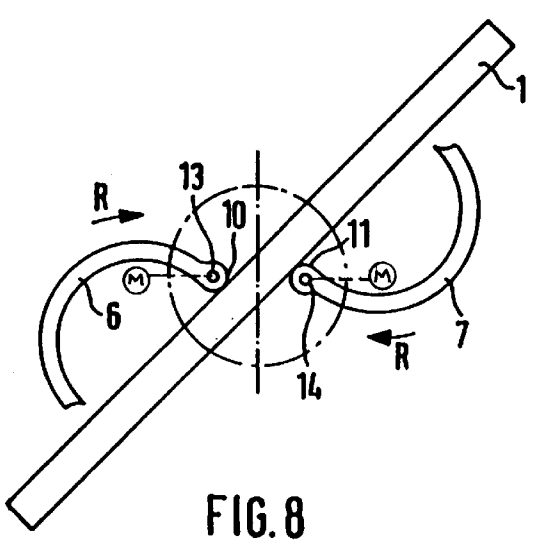
Figure 7:
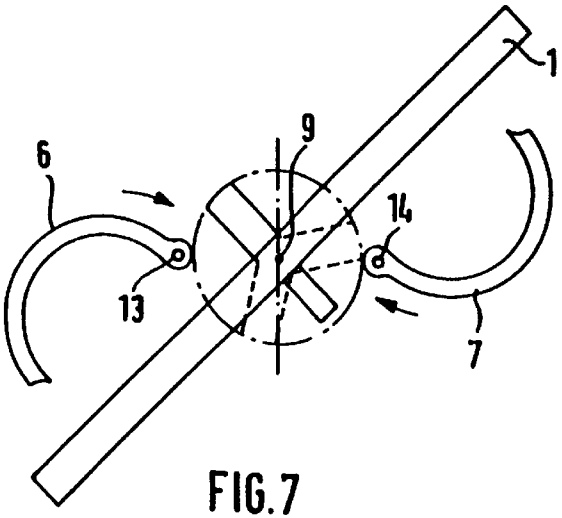

Reference is now made to a description of the third embodiment which is illustrated in FIGS. 7 to 12. The apparatus for producing a honeycomb body from a stack 1 has two former segments 6, 7 which are each pivotable about a respective pivot axis 13, 14. Each segment 6, 7 is displaceable radially with respect to an axis 9 of a winding device 9'. FIG. 7 shows the configuration of a stack in an open former 5. After the stack has been disposed in the former and engaged by the winding device, the former segments 6, 7 are moved radially inwardly in the direction of arrows R towards the stack 1, for instance by stepping motors M shown in FIG. 8. One end of each former segment 6, 7 comes to bear against the stack. Respective pivot axes 13 and 14 are respectively provided at those ends of the former segments bearing against the stack. The ends of the former segments which bear against the stack 1 form respective support devices 10, 11. During the operation of twisting the stack 1 in the direction of rotation S, the former segments 6, 7 are displaced radially outwardly in a direction B, in which case the support devices 10, 11 always bear against the stack. That can be clearly seen in particular in FIGS. 9, 10 and 11. FIG. 9 shows an adjustable spring K providing a spring force against which each pivot axis 13, 14, 15 is movable away from the central axis 9. The spring characteristic of the spring K may be of a degressive nature and the springs K may be tension springs or compression springs.

Figure 12:
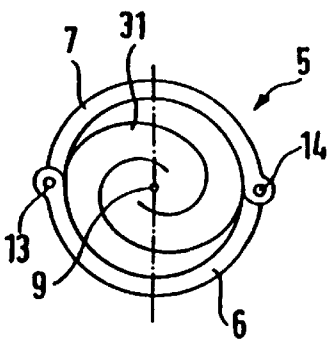
Figure 11:
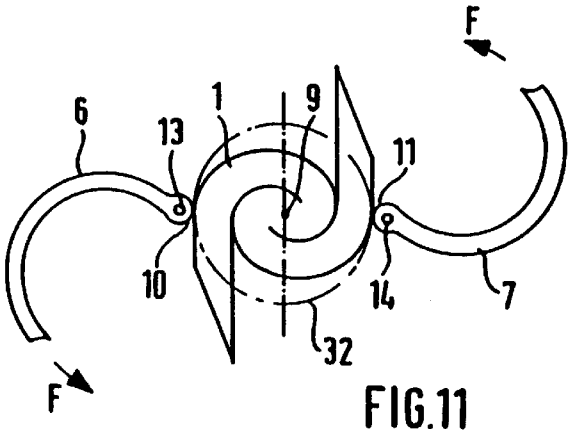
Figure 10:
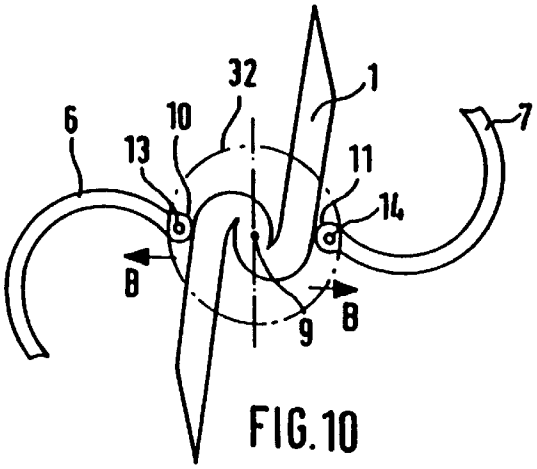

After the winding operation is substantially concluded the former segments 6, 7 are pivoted about their respective pivot axes 13, 14 and the former is closed. FIGS. 11 and 12 correspond to FIGS. 2 and 3. Reference is made in terms of their full content to the description of those figures.

Figure 14:
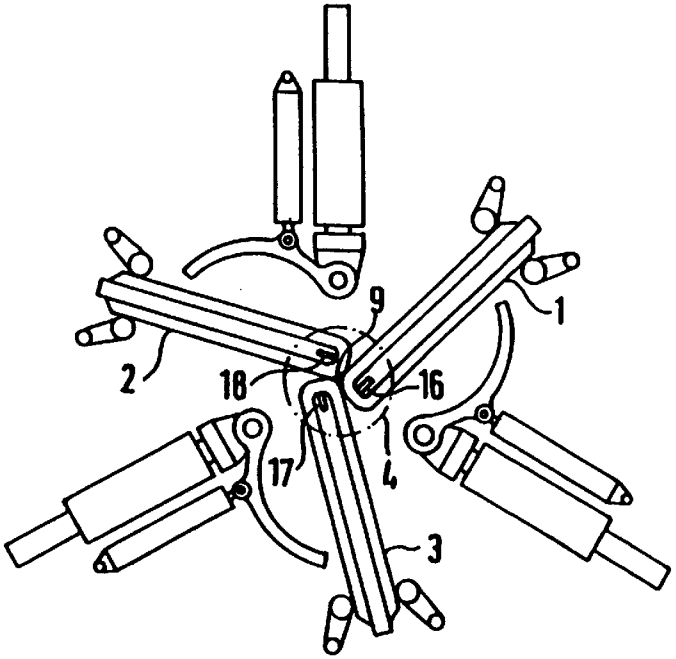
FIGS. 13 to 19 are diagrammatic, plan views of a fourth embodiment of an apparatus.
Figure 13:
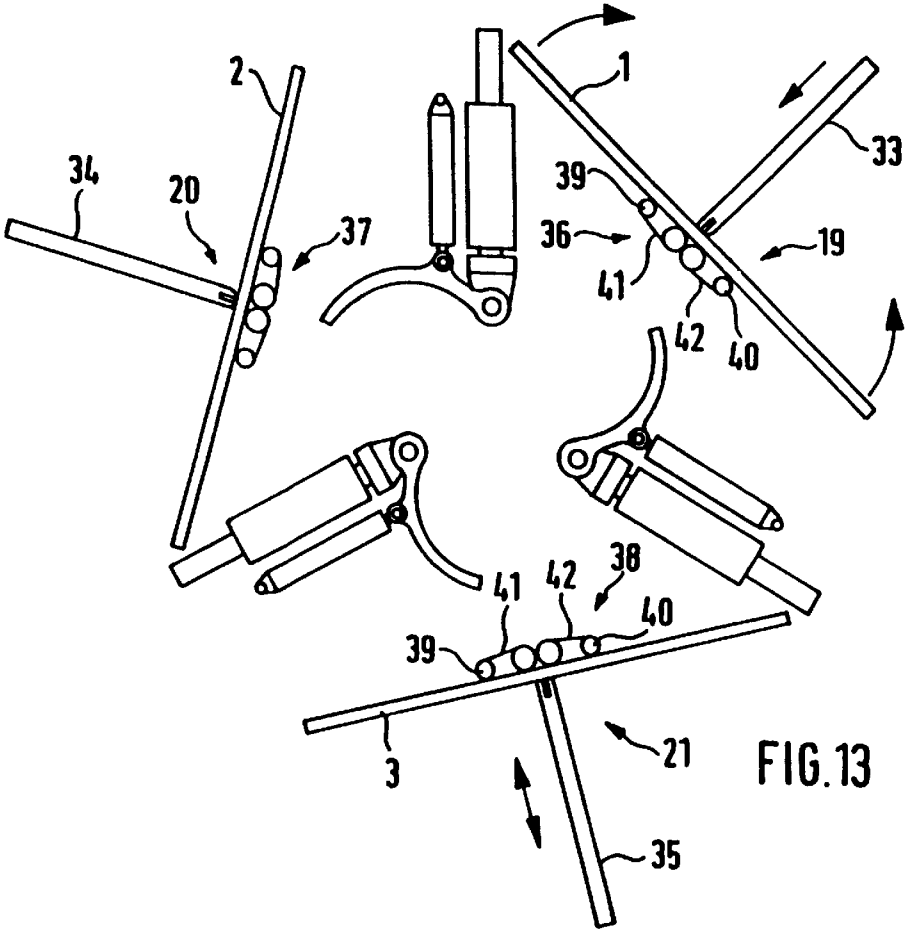

An apparatus as is shown in FIGS. 13 to 19 is proposed in order to produce a honeycomb body with a plurality of passages which are permeable to a fluid, in particular a catalyst carrier body, from a plurality of at least partially structured sheet metal layers, including three stacks 1, 2 and 3 of sheet metal layers. The three stacks 1, 2 and 3 are each folded about a respective bend line 16, 17 and 18 in a central region of the honeycomb body and twisted in a folded condition in the same direction around each other and around a central region 4 having the bend lines 16, 17 and 18. The apparatus includes three folding units 19, 20 and 21. Each folding unit 19, 20 and 21 has a respective folding bar 33, 34 and 35. Each folding bar 33, 34 and 35 is reciprocably movable along a respective straight line. Each folding unit 19, 20 and 21 has a two-part entry lock device 36, 37 and 38. The lock devices 36, 37 and 38 each have two gates 41, 42 which are pivotable about axes 39, 40. Pivotability takes place against a force. Each stack is disposed parallel to a respective lock device 36, 37 and 38 for the purpose of folding a stack 1, 2 and 3. The bar 33 is disposed symmetrically between the lock device gates 41, 42. The stack 1 is folded in a direction indicated by curved arrows about the bend line 16 by the application of the force of the bar 33 against the stack 1 and by virtue of the pivotability of the gates 41, 42. The folded condition is shown in FIG. 14. The stacks 1, 2 and 3 are introduced into the central region of the apparatus along with the folding operation. The stacks 1, 2 and 3 are disposed symmetrically with respect to the axis 9. After the folding operation has been effected, the bars 33, 34 and 35 are moved out of the respective stack. The bending devices 19, 20 and 21 are no longer shown in the following FIGS. 15 to 19, for the sake of enhanced clarity of the drawings.

Figure 16:
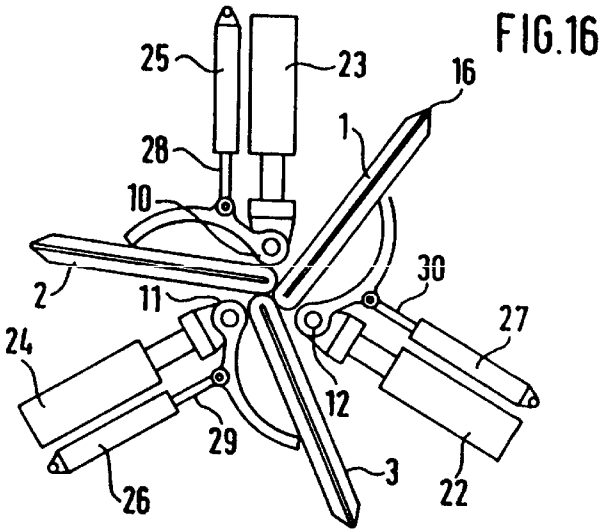
Figure 17:
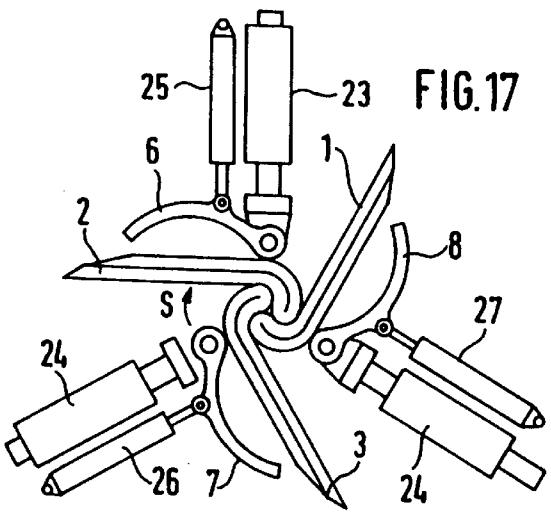
Figure 15:
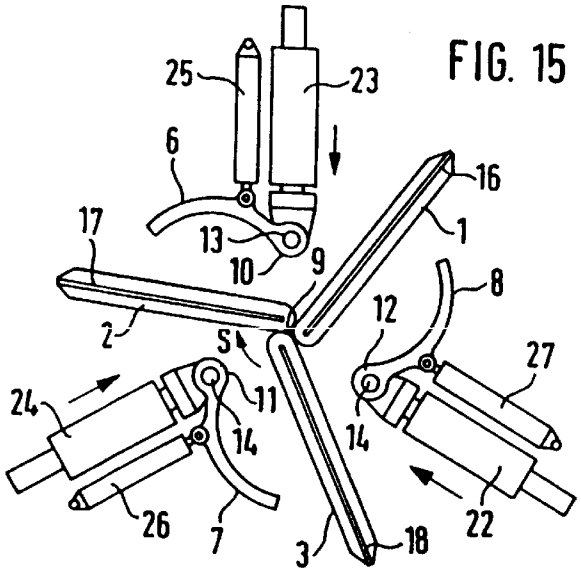
Figure 18:
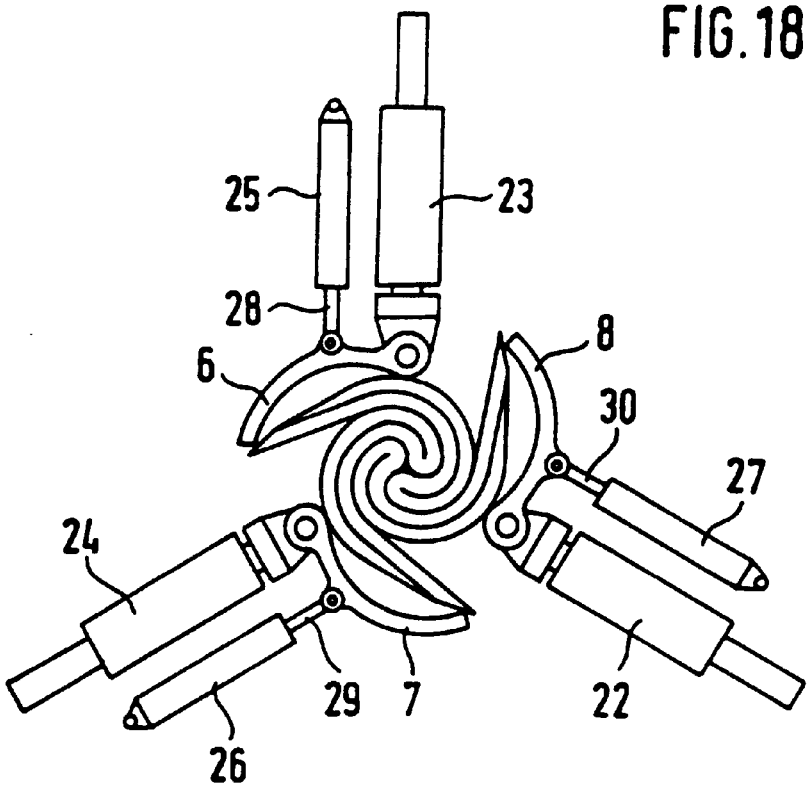
Figure 19:
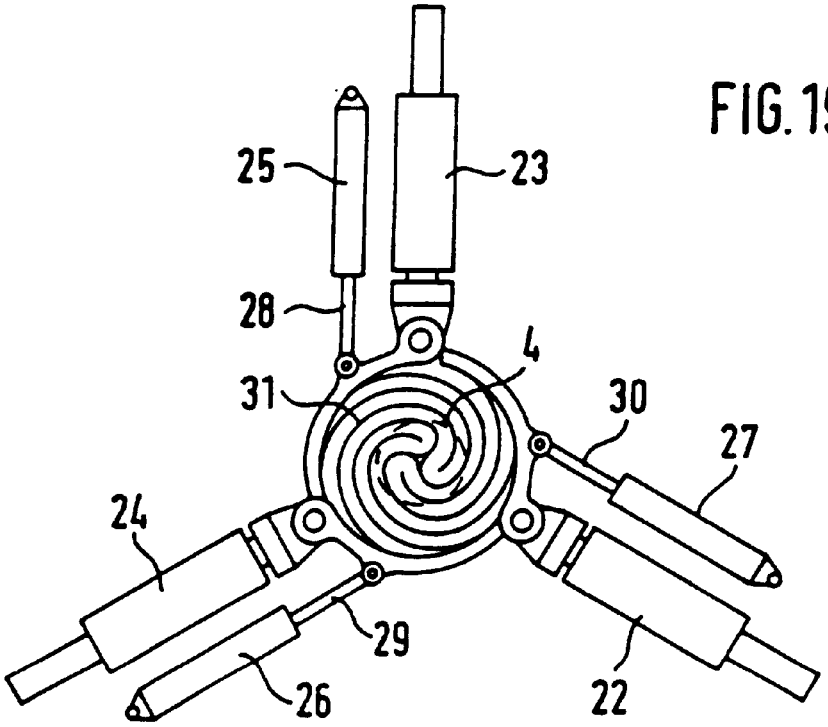

After a winding device has engaged each stack 1, 2 and 3, the individual former segments 6, 7 and 8 are displaced radially inwardly toward the axis 9 through the use of a piston-cylinder unit 22, 23 and 24 which may be hydraulically or pneumatically operated. The displacement operation continues until the support devices 10, 11 and 12 which are provided at an end of each former segment 6, 7 and 8 bear against the respective stack 1, 2 and 3, as is shown in FIG. 16. When the support devices bear against the stacks 1, 2 and 3, the winding operation can be initiated. FIG. 17 shows a condition of the winding of the individual stacks 1, 2 and 3. The former segments 6, 7 and 8 are each pivotable about a respective pivot axis 13, 14 for the purposes of closing the former 5. FIGS. 18 and 19 correspond to FIGS. 5 and 6, with reference being directed to the full content thereof.

The honeycomb bodies that are described with reference to the embodiments are of a circular cross-section. In accordance with the invention it is also possible to produce honeycomb bodies which are not of a circular cross-section. That may also involve, for example, honeycomb bodies which are of an elliptical, partly circular or epitrochoidal cross-section.

I claim:

1. A process for producing a honeycomb body with a multiplicity of fluid-permeable passages from a multiplicity of at least partially structured sheet metal layers, which comprises:

stacking at least partially structured sheet metal layers into a stack;

opening a former having former segments corresponding to an outside shape of a honeycomb body to be produced;

introducing the stack into the open former;

holding the stack in the former in a central region with a winding device;

winding the stack around in a given direction of rotation; and closing the former by pivotal movement of the former segments in a direction opposite to the given direction when a predetermined degree of winding is reached.

2. The process according to claim 1, which comprises bearing against each stack in the central region with a respective support device, and moving each support device radially out of the central region during the winding step while each support device always bears against a stack.

3. A process for producing a honeycomb body having a multiplicity of fluid-permeable passages from a multiplicity of at least partially structured sheet metal layers, which comprises:

stacking a plurality of at least partially structured sheet metal layers into a plurality of stacks;

folding each stack about a respective bend line;

opening a former having former segments corresponding to an outside shape of a honeycomb body to be produced;

introducing the stacks into the open former;

holding the stacks in the former in a central region with a winding device;

winding the stacks around each other in a given direction of rotation; and closing the former by pivotal movement of the former segments in a direction opposite to the given direction when a predetermined degree of winding is reached.

4. The process according to claim 3, which comprises bearing against each stack in the central region with a respective support device, and moving each support device radially out of the central region during the winding step while each support device always bears against a stack.

* * * * *

UNITED STATES PATENT AND TRADEMARK OFFICE

CERTIFICATE OF CORRECTION

PATENT NO. : 6,049,961
DATED : April 18, 2000
INVENTOR(S) : Ludwig Wieres

It is certified that error appears in the above-identified patent and that said Letters Patent is hereby corrected as shown below:

Column 3,
Lines 42 and 43, should read as follows:
-- the guide groove has a T-shaped or dovetail-shaped cross-section. --

Signed and Sealed this

Tenth Day of September, 2002

*Attest:*

*Attesting Officer*

JAMES E. ROGAN
*Director of the United States Patent and Trademark Office*